United States Patent [19]

Shimotsuma et al.

[11] 4,270,980

[45] Jun. 2, 1981

[54] METHOD FOR RECOVERING AND UTILIZING HEAT OF COKE-OVEN GAS

[75] Inventors: Teruo Shimotsuma; Kazuo Kunioka; Hiroaki Nishio, all of Yokohama; Yasuo Okuyama, Kawasaki, all of Japan

[73] Assignee: Nippon Kokan Kabushiki Kaisha, Tokyo, Japan

[21] Appl. No.: 35,457

[22] Filed: May 3, 1979

[30] Foreign Application Priority Data

May 26, 1978 [JP] Japan ..... 53-62183

[51] Int. Cl.[3] ..... C10B 49/02; C10B 51/00; C10B 55/02; C10B 57/10

[52] U.S. Cl. ..... 201/28; 48/210; 201/23; 201/29; 201/36; 201/41; 201/45

[58] Field of Search ..... 201/23, 24, 28, 29, 201/31, 36, 41, 43, 45; 48/210

[56] References Cited

U.S. PATENT DOCUMENTS

| | | | |
|---|---|---|---|
| 3,432,398 | 3/1969 | Schmidt | 201/38 |
| 3,454,383 | 7/1969 | Pirsh et al. | 201/31 X |
| 3,867,110 | 2/1975 | Schora et al. | 201/31 X |
| 4,104,128 | 8/1978 | Faber et al. | 201/28 X |

FOREIGN PATENT DOCUMENTS

| | | | |
|---|---|---|---|
| 2103026 | 8/1971 | Fed. Rep. of Germany | 201/31 |

*Primary Examiner*—Joseph Scovronek

*Attorney, Agent, or Firm*—Frishauf, Holtz, Goodman & Woodward

[57] ABSTRACT

A method for recovering and utilizing heat of coke-oven gas, which comprises: through heat exchange with a high-temperature coke-oven gas generated from a coke oven battery and containing vaporized coal tar, vaporized low boiling point substances and dust, drying and preheating a blended raw material coal fine to be charged into coking ovens of said coke oven battery, and, on the other hand, causing most of said coal tar contained in said coke-oven gas to condense and deposit onto the particle surfaces of said coal fine during the process of said heat exchange, thereby recovering and utilizing sensible heat and condensation heat of said coke-oven gas and substances contained therein, and at the same time, eliminating most of the contained coal tar from said coke-oven gas.

3 Claims, 2 Drawing Figures

TURBINE
GEN
(THERMAL INSULATION)
SCRUBBER
EVACUATING BLOWER
HOOD
COKE OVEN
VIBRATOR
58

METHOD FOR RECOVERING AND UTILIZING HEAT OF COKE-OVEN GAS

FIELD OF THE INVENTION

The present invention relates to a method for recovering and utilizing sensible heat and condensation heat of a high-temperature coke-oven gas generated from a coke oven battery and substances contained therein such as vaporized coal tar and vaporized low boiling point substances.

BACKGROUND OF THE INVENTION

In the conventional operation of a coke oven battery, a crude coke-oven gas of about 800° C. is collected through a riser installed at the top of the coke oven battery to a dry main where the crude coke-oven gas is humidified and cooled to from about 80° to about 100° C. by spraying ammonia water. As a result, vaporized coal tar contained in the crude coke-oven gas mostly condenses in the dry main, is separated from the crude coke-oven gas, and discharged from the dry main together with ammonia water. The coke-oven gas, from which coal tar has been mostly eliminated, is then introduced into a primary cooler of the heat exchanger type comprising a plurality of tubes, where the coke-oven gas is dehumidified and cooled to from about 30° to about 40° C. through heat exchange with sea water or ammonia water, and the remaining coal tar and ammonia water are almost completely separated by condensation. The coal tar and the ammonia water thus separated are discharged from the primary cooler. The coal tar and the ammonia water discharged from the dry main and the primary cooler are introduced into a tar decanter, where the coal tar and the ammonia water are separated from each other. Ammonia water is synthesized in a considerable amount in the various processes mentioned above, especially in the dry main. The ammonia water discharged from the tar decanter is therefore directed again to the dry main and the primary cooler after removing of excess ammonia water, in recycle for use in cooling the crude coke-oven gas.

In the aforementioned conventional processes, it is the present situation that sensible heat and condensation heat of crude coke-oven gas and substances contained therein such as vaporized coal tar transfer to a large quantity of cooling water such as ammonia water and sea water, and are wasted with no utilization.

One of the conceivable methods for recovering and utilizing sensible heat and condensation heat of a crude coke-oven gas and substances contained therein such as vaporized coal tar comprises introducing a crude coke-oven gas of about 800° C. into a heat exchanger such as a boiler, and converting water into steam through heat exchange with these sensible heat and condensation heat, thereby recovering these sensible heat and condensation heat in the form of steam. In this method, however, during the process of temperature drop by heat exchange, vaporized coal tar contained in the crude coke-oven gas deposits onto the tube walls of the heat exchanger, resulting in various disadvantages such as decrease in the heat efficiency and clogging of tubes. Because of these possible disadvantages, the utilization of crude coke-oven gas in a heat exchanger has not as yet been put to practice. While, in order to recover and utilize effectively sensible heat and condensation heat of a crude coke-oven gas and substances contained therein such as vaporized coal tar, it is absolutely necessary to establish a technique to eliminate the coal tar deposit on the tube walls of the heat exchanger, such a technique has not as yet been developed as far as we know.

In the operation of a coke oven battery, on the other hand, the preheated coal charging method or the dried coal charging method is commonly adopted with a view to improving coke productivity through increase of the quantity of coal charge per oven. The preheated coal charging method comprises charging a blended raw material coal fine preheated to a state substantially free of water into coking ovens of a coke oven battery. The dried coal charging method comprises charging a blended raw material coal fine dried to a humidity of from about 2 to about 6 wt.% into coking ovens of a coke oven battery. In general, preheating or drying of a blended raw material coal fine is carried out through heat exchange with a high-temperature combustion exhaust gas of a clean coke-oven gas from which substances contained therein such as dust, coal tar and low boiling point substances have been substantially completely eliminated as mentioned above, or of a heavy oil.

In the preheated coal charging method, in which the blended raw material coal fine is preheated to a state substantially free of water, much troubles are caused by coal dust. It is therefore necessary to take such countermeasures, to prevent troubles caused by coal dust, as adding heavy oil to a coal charge, separately installing a charging main for charging coal, or providing a settling basin, thus forming a drawback of requiring additional equipment and operating costs. In the preheated coal charging method, furthermore, the substantial absence of water in the blended raw material coal fine causes a problem of precipitation of coal tar slag in a large quantity in the treatment process of coal tar, a by-product. These difficulties considerably reduce advantages of the preheated coal charging method. In the dried coal charging method also, on the other hand, as in the above-described preheated coal charging method, troubles are inevitably caused more or less by coal dust, and moreover, the water content of the blended raw material coal fine, if reduced to less than about 4.5 wt.%, causes a large quantity of coal tar slag to precipitate during the treatment process of coal tar.

SUMMARY OF THE INVENTION

A pincipal object of the present invention is therefore to provide, in the operation of a coke oven battery, a method for recovering sensible heat and condensation heat of a coke-oven gas generated from the coke oven battery and substances contained therein such as vaporized coal tar and vaporized low boiling point substances without suffering from disadvantages caused by coal tar contained in the crude coke-oven gas, and effectively utilizing said sensible heat and said condensation heat for drying and preheating a blended raw material coal fine to be charged into coking ovens of the coke oven battery.

Another object of the present invention is to provide, in the operation of a coke oven battery, a method for effectively recovering and utilizing sensible heat and condensation heat of a crude coke-oven gas generated from said coke oven battery and substances contained therein such as vaporized coal tar and vaporized low boiling point substances, so as to obtain a dried and preheated blended raw material coal fine to be charged into coking ovens of the coke oven battery without occurrence of troubles caused by coal dust.

In accordance with one of the features of the present invention, there is provided a method for recovering and utilizing heat of a coke-oven gas, which comprises the steps of:

introducing at least a part of a high-temperature coke-oven gas generated from a coke oven battery and containing vaporized coal tar, vaporized low boiling point substances and dust into a drying and preheating chamber, while supplying a blended raw material coal fine to be charged into coking ovens of said coke oven battery into said drying and preheating chamber;

drying and preheating said coal fine through heat exchange with said coke-oven gas in said drying and preheating chamber, while causing most of the vaporized coal tar contained in said coke-oven gas to condense and deposit onto the particle surfaces of said coal fine, thereby recovering and utilizing sensible heat and condensation heat of said coke-oven gas and substances contained therein, and at the same time, eliminating by separation most of coal tar contained in said coke-oven gas therefrom;

passing said coke-oven gas from which most of coal tar contained therein has been so eliminated through at least one cyclone, a wet type scrubber, a primary cooler and a by-product treatment system in this order, and substantially completely eliminating by separation substances contained in said coke-oven gas therefrom during said passing, thereby converting said coke-oven gas into a clean coke-oven gas; and, on the other hand, charging said coal fine, dried and preheated in said drying and preheating chamber and onto the particle surfaces of which coal tar has deposited, into coking ovens of said coke oven battery.

DETAILED DESCRIPTION OF PREFERRED EMBODIMENTS

Figures 1, 2, 3:
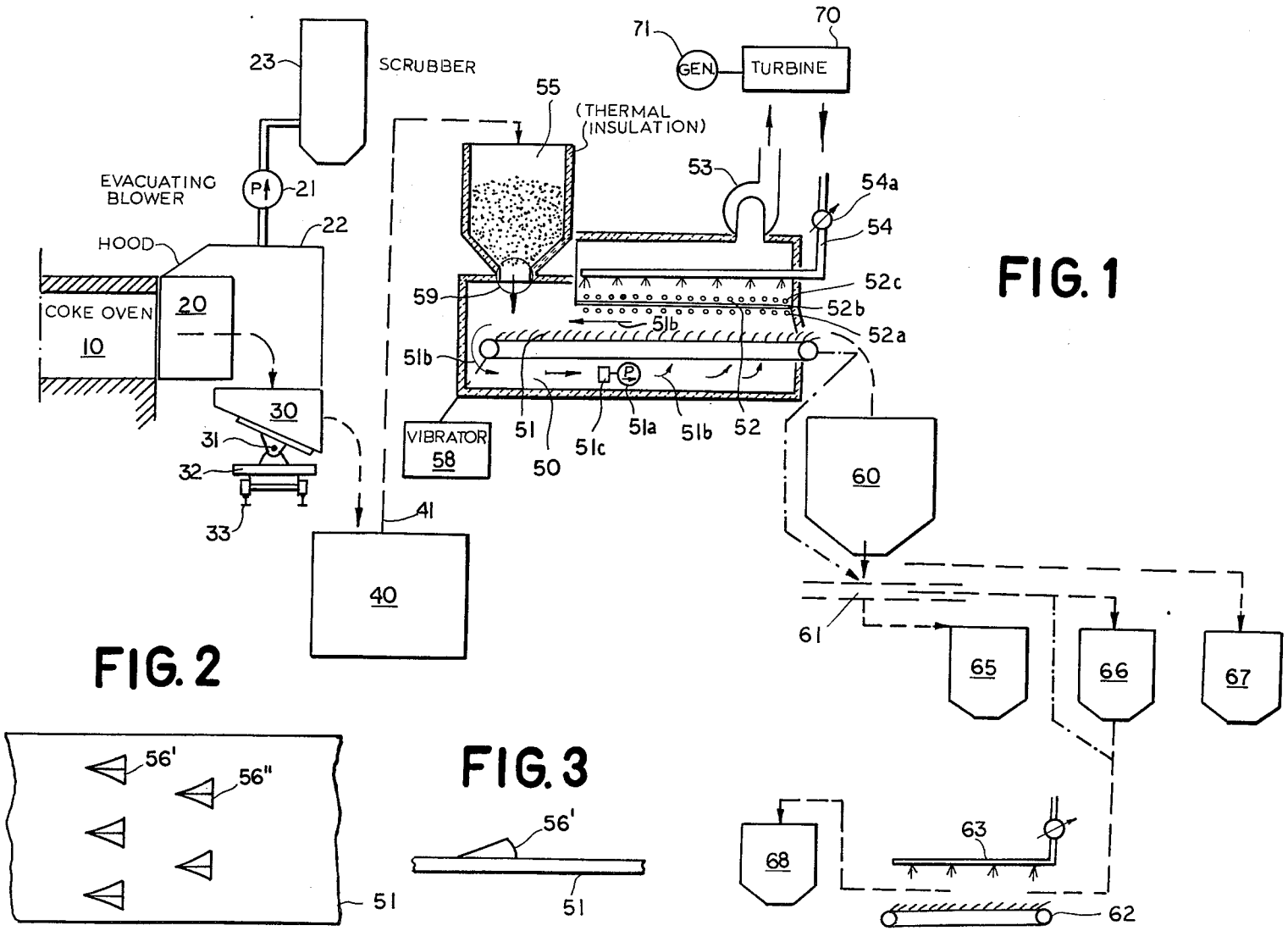
FIG. 1 is a schematic drawing illustrating an embodiment of the method of the present invention; and, FIG. 2 is a schematic drawing illustrating another embodiment of the method of the present invention.

From the aforementioned point of view, we have carried out extensive studies with a view to effectively recovering and utilizing sensible heat and condensation heat of a crude coke-oven gas generated from a coke oven battery and substances contained therein such as vaporized coal tar and vaporized low boiling point substances without suffering from disadvantages caused by coal tar contained in said crude coke-oven gas, and at the same time, solving coal dust troubles having so far occurred inevitably in the conventional preheated coal charging method or the dried coal charging method. As a result, we found that, by drying and preheating a blended raw material coal fine to be charged into coking ovens of a coke oven battery through heat exchange with a high-temperature crude coke-oven gas generated from said coke oven battery and containing such substances as vaporized coal tar and vaporized low boiling point substances, it is possible not only to effectively recover and utilize sensible heat and condensation heat of the crude coke-oven gas and the substances contained therein, but also to cause most of the vaporized coal tar contained in the crude coke-oven gas to condense and deposit onto the particle surfaces of the coal fine, thus permitting all out resolution of the disadvantages by coal tar and coal dust troubles mentioned above.

Now, the method of the present invention is described with reference to the accompanying drawings.

FIG. 1 is a schematic drawing illustrating an embodiment of the method of the present invention (hereinafter referred to as the "first embodiment"). In the first embodiment, as shown in FIG. 1, at least a part of a high-temperature coke-oven gas 2 of about 800° C. generated from a coke oven battery 1 and containing such substances as vaporized coal tar, vaporized low boiling point substances and dust is introduced, into a mixing chamber 4, solely or together with a low-temperature clean coke-oven gas 3 described later. A low-temperature gas substantially free of oxygen such as a blast furnace top gas, a recovered gas of a top-blowing oxygen converter and a combustion exhaust gas may be used in place of the clean coke-oven gas 3. The crude coke-oven gas 2 and the gas substantially free of oxygen such as the clean coke-oven gas 3 are mixed in the mixing chamber 4 into a mixed coke-oven gas with a prescribed temperature, and said mixed coke-oven gas is introduced into a drying and preheating chamber 5. The excess remaining crude coke-oven gas 2, if any, is directly introduced into a wet type scrubber 10 without passing through the mixing chamber 4 and the drying and preheating chamber 5. As mentioned above, the crude coke-oven gas 2 is mixed, as required, with the low-temperature gas substantially free of oxygen such as the clean coke-oven gas 3 for the only purpose of reducing the temperature of the high-temperature crude coke-oven gas 2 on the entry side of the drying and preheating chamber 5 to a prescribed temperature. Therefore, no difference in the processes mentioned below is caused between the case with only the crude coke-oven gas 2 and the case with the mixed coke-oven gas. With this fact in view, the crude coke-oven gas 2 and the mixed coke-oven gas are hereinafter generally referred to as the "coke-oven gas 2".

On the other hand, a blended raw material coal fine 6 to be charged into coking ovens (not shown) of the coke oven battery 1 and containing a water of from about 7 to about 10 wt.% is supplied through a coal bin 7 into the drying and preheating chamber 5, where the coal fine 6 is fluidized by the coke-oven gas 2 and dried and preheated to a state within the range of from a water content of about 6 wt.% to a state substantially free of water through heat exchange with the coke-oven gas 2. The preheating temperature of the coal fine 6 should preferably be a temperature not reaching the initial carbonization temperature of the coal fine 6, i.e., a temperature of up to 300° C. During the process of the above-mentioned drying and preheating of the coal fine 6 through heat exchange with the coke-oven gas 2, the vaporized coal tar contained in the coke-oven gas 2 mostly condenses and deposits onto the particle surfaces of the coal fine 6.

The coke-oven gas 2*a*, of which the temperature has been reduced to from about 120° to about 350° C. and the vaporized coal tar contained has mostly been eliminated through heat exchange with the coal fine 6 in the drying and preheating chamber 5, is introduced into a first cyclone 8, where the dust contained is mostly eliminated by separation. The coke-oven gas 2*b*, from which most of the dust contained has been eliminated in the first cyclone 8, is introduced into a second cyclone 9, where most of the remaining dust still contained is eliminated by separation. It is needless to mention that coal tar condenses and deposits also onto the particle surfaces of the dust separated in the first cyclone 8 and the second cyclone 9. The number of cyclones is not limited to two, but cyclones in an appropriate number may be used as required.

The coke-oven gas 2c, from which most of the remaining dust has been eliminated in the second cyclone 9, is introduced into a wet type scrubber 10. On the other hand, as mentioned previously, the excess crude coke-oven gas 2 is directly introduced into the wet type scrubber 10 without passing through the mixing chamber 4 and the drying and preheating chamber 5. In the wet type scrubber 10, an almost total amount of the dust contained and most of the coal tar and the low boiling point substances are eliminated by scrubbing through spraying of ammonia water from the coke-oven gas 2c and the directly introduced crude coke-oven gas 2 which are at the same time humidified and cooled to from about 80° to about 90° C. The dust, the coal tar and the low boiling point substances 12 separated from the coke-oven gas 2c and the crude coke-oven gas 2 in the wet type scrubber 10 are sent, together with ammonia water 11, to a by-product treatment system 13, where separation is conducted into dust, coal tar, low boiling point substances and ammonia water, respectively.

The coke-oven gas 2d, from which an almost total amount of the dust and most of the coal tar and the low boiling point substances have been eliminated in the wet type scrubber 10, is introduced into a heat exchanger type primary cooler 14 comprising a plurality of tubes, where the coke-oven gas 2d is dehumidified and cooled to from about 30° to about 40° C. through heat exchange with a cooling water 15 such as sea water, and at the same time, the remaining coal tar still contained and the ammonia water additionally contained on the way are substantially completely eliminated by condensation, together with most of the low boiling point substances. The coal tar, the low boiling point substances and the ammonia water separated from the coke-oven gas 2d in the primary cooler 14 are sent to the by-product treatment system 13 for separation into individual substances.

The coke-oven gas 2e, from which the coal tar and the ammonia water have been substantially completely eliminated, together with most of the low boiling point substances, in the primary cooler 14, is sent to the by-product treatment system 13 by a blower 16, where the substances contained such as dust, coal tar, low boiling point substances and ammonia water are finally eliminated by separation.

A part of the clean coke-oven gas 3, from which the substances contained such as dust, coal tar, low boiling point substances and ammonia water have been finally eliminated in the by-product treatment system 13, is recovered as a fuel gas G, while, as mentioned above, the remaining clean coke-oven gas 3 is introduced, as required, into the mixing chamber 4, where the remaining clean coke-oven gas 3 is mixed with the crude coke-oven gas 2 generated from the coke oven battery 1 into a mixed coke-oven gas at a prescribed temperature for use in recycle.

The dust, the coal tar, the low boiling point substances and the ammonia water which have been separated from the coke-oven gases 2c and 2d in the wet type scrubber 10 and the primary cooler 14 and sent to the by-product treatment system 13 (including those finally separated in the by-product treatment system 13) are separated into individual substances in the by-product treatment system 13. The dust, the coal tar and the low boiling point substances thus separated are recovered as by-products or raw materials therefor 18, whereas the ammonia water thus separated is introduced into the wet type scrubber 11 as an ammonia water 11 for cooling for use in recycle after removing of excess ammonia water synchronized during the above-mentioned processes.

On the other hand, the blended raw material coal fine 6a, dried and preheated in the drying and preheating chamber 5 and onto the particle surfaces of which coal tar has deposited, overflows continuously from the drying and preheating chamber 5, joins the coal dust 6b collected by separation in the first cyclone 8 and the second cyclone 9 and on the particle surfaces of which coal tar has deposited, in a ratio of about 70 wt.% for the former and about 30 wt.% for the latter, and is collected in a reserving hopper 19. The mixture 6c of the blended raw material coal fine 6a and the coal dust 6b collected in the reserving hopper 19 is charged into the coking ovens (not shown) of the coke oven battery 1 by means of a coal charging car 21 through or not passing through a coal tower 20.

FIG. 2 is a schematic drawing illustrating another embodiment of the present invention (hereinafter referred to as the "second embodiment"). In FIG. 2, the same referential numerals as those used in FIG. 1 represent the same things as in FIG. 1. The second embodiment described below is identical in principle with the first embodiment described above. The difference between the two embodiments lies in that, in the first embodiment, as shown in FIG. 1, the blended raw material coal fine 6 supplied into the drying and preheating chamber 5 is separated into the dried and preheated coal fine 6a and the coal dust 6b on the exit side of the drying and preheating chamber 5, which join together again in the reserving hopper 19, whereas, in the second embodiment, as shown in FIG. 2, the total amount of the blended raw material coal fine 6 including the coal dust, supplied into the drying and preheating chamber 5 and dried and preheated therein is sent to the first cyclone 8 and the second cyclone 9 by the pressure of the coke-oven gas 2a. This difference is achieved by adjusting the flow rate and the flow velocity of the coke-oven gas 2 by means of the blower 16 shown in FIGS. 1 and 2.

More specifically, in the first embodiment, as shown in FIG. 1, the flow rate and the flow velocity of the coke-oven gas 2 passing through the drying and preheating chamber 5 and, as required, of the clean coke-oven gas 3 are adjusted by means of the blower 16, whereby the blended raw material coal fine 6a supplied into the drying and preheating chamber 5 is fluidized and caused to overflow from the drying and preheating chamber 5, while the coal dust 6b finer in size and lighter in weight than the coal fine 6a is sent to the first cyclone 8 and the second cyclone 9 by means of the coke-oven gas 2a. In the second embodiment, in contrast, as shown in FIG. 2, the flow rate and the flow velocity of the coke-oven gas 2 passing through the drying and preheating chamber 5 and, as required, of the clean coke-oven gas 3 are adjusted by means of the blower 16 so that the flow rate and the flow velocity become larger than in the first embodiment, whereby the total amount of the blended raw material coal fine 6d including the coal dust, supplied into the drying and preheating chamber 5, is sent, by the pressure of the coke-oven gas 2a, to the first cyclone 8 and the second cyclone 9, where the blended raw material coal fine 6d including the coal dust is separated from the coke-oven gas 2a. The total amount of the blended raw material coal fine 6*d* including the coal dust, separated and collected in the first cyclone 8 and the second cyclone 9 and on the particle surfaces of which the coal tar has deposited, is collected in the reserving hopper 19, and is then charged into the coking ovens (not shown) of the coke oven battery 1 by means of a coal charging car 21 through or not passing through the coal tower 20.

As shown in FIG. 2, the other processes in the second embodiment are completely the same as those in the first embodiment described above, and are not therefore described here.

Now, the method of the present invention is described in more detail with reference to examples.

EXAMPLE 1

A blended raw material coal fine having the properties as shown in Table 2 was prepared from the kinds of coal at the blending ratios as shown in Table 1. Then, in accordance with the first embodiment of the method of the present invention described above with reference to FIG. 1, the blended raw material coal fine 6 thus prepared was dried in the drying and preheating chamber 5, through heat exchange with a mixed coke-oven gas of a crude coke-oven gas 2 and a recycle clean coke-oven gas 3, to a prescribed water content, and most of vaporized coal tar contained in the crude coke-oven gas 2 was caused to condense and deposit onto the particle surfaces of said blended raw material coal fine 6.

Table 3 shows, for Example 1, the water content, the temperature and the charging bulk density before said drying treatment, and the water content, the amount of coal tar deposit, the temperature and the charging bulk density after said drying treatment of the blended raw material coal fine 6; the consumption, the coal tar content and the temperature of the crude coke-oven gas 2; the consumption and the temperature of the recycle clean coke-oven gas 3; the consumption and the temperature, on the entry and exit sides of the drying and preheating chamber 5, of the mixed coke-oven gas of said crude coke-oven gas 2 and said clean coke-oven gas 3; the yield rate and the strength of coke produced from the blended raw material coal fine 6*c* subjected to said drying treatment and having coal tar deposit thereof; and, the recovered amount of sensible heat and condensation heat of the crude coke-oven gas 2 and the substances contained therein.

EXAMPLE 2

As in Example 1, another blended raw material coal fine having the properties as shown in Table 2 was prepared from the kinds of coal at the blending ratios as shown in Table 1. Then, in accordance with the second embodiment of the method of the present invention described above with reference to FIG. 2, the blended raw material coal fine 6 thus prepared was dried in the drying and preheating chamber 5, through heat exchange with a mixed coke-oven gas of a crude coke-oven gas 2 and a recycle clean coke-oven gas 3, to a prescribed water content, and most of vaporized coal tar contained in the crude coke-oven gas 2 was caused to condense and deposit onto the particle surfaces of said blended raw material coal fine 6.

Table 3 shows, for Example 2, the water content, the temperature and the charging bulk density before said drying treatment, and the water content, the amount of coal tar deposit, the temperature and the charging bulk density after said drying treatment of the blended raw material coal fine 6; the consumption, the coal tar content and the temperature of the crude coke-oven gas 2; the consumption and the temperature of the recycle clean coke-oven gas 3; the consumption and the temperature, on the entry and exit sides of the drying and preheating chamber 5, of the mixed coke-oven gas of said crude coke-oven gas 2 and said clean coke-oven gas 3; the yield rate and the strength of coke produces from the blended raw material coal fine 6*d* subjected to said drying treatment and having coal tar deposit thereon; and, the recovered amount of sensible heat and condensation heat of the crude coke-oven gas 2 and the substances contained therein.

EXAMPLE 3

As in Example 1, further another blended raw material coal fine having the properties as shown in Table 2 was prepared from the kinds of coal at the blending ratios as shown in Table 1. Then, in accordance with the first embodiment of the method of the present invention described above with reference to FIG. 1, the blended raw material coal fine 6 thus prepared was dried and preheated in the drying and preheating chamber 5, through heat exchange with a mixed coke-oven gas of a crude coke-oven gas 2 and a recycle clean coke-oven gas 3, to a state of said blended raw material coal fine 6 substantially free of water, and most of vaporized coal tar contained in the crude coke-oven gas 2 was caused to condense and deposit onto the particle surfaces of said blended raw material coal fine 6.

Table 3 shows, for Example 3, the water content, the temperature and the charging bulk density before said drying and preheating treatment, and the water content, the amount of coal tar deposit, the temperature and the charging bulk density after said drying and preheating treatment of the blended raw material coal fine 6; the consumption, the coal tar content and the temperature of the crude coke-oven gas 2; the consumption and the temperature of the recycle clean coke-oven gas 3; the consumption and the temperature, on the entry and exit sides of the drying and preheating chamber 5, of the mixed coke-oven gas of said crude coke-oven gas 2 and said clean coke-oven gas 3; the yield rate and the strength of coke produced from the blended raw material coal fine 6*c* subjected to said drying preheating treatment and having coal tar deposit thereon; and, the recovered amount of sensible heat and condensation heat of the crude coke-oven gas 2 and the substances contained therein.

EXAMPLE 4

As in Example 1, further another blended raw material coal fine having the properties as shown in Table 2 was prepared from the kinds of coal at the blending ratios as shown in Table 1. Then, in accordance with the second embodiment of the method of the present invention described above with reference to FIG. 2, the blended raw material coal fine 6 thus prepared was dried and preheated in the drying and preheating chamber 5, through heat exchange only with a crude coke-oven gas 2, to a state of said blended raw material coal fine 6 substantially free of water, and most of vaporized coal tar contained in the crude coke-oven gas 2 was caused to condense and deposit onto the particle surfaces of said blended raw material coal fine 6.

Table 3 shows, for Example 4, the water content, the temperature and the charging bulk density before said drying and preheating treatment, and the water content, the amount of coal tar deposit, the temperature and the charging bulk density after said drying and preheating treatment of the blended raw material coal fine 6, the consumption, the coal tar content and the temperature of the crude coke-oven gas 2; the temperature, on the entry and exit sides of the drying and preheating chamber 5, of the crude coke-oven gas 2; the yield rate and the strength of coke produced from the blended raw material coal fine 6*d* subjected to said drying and preheating treatment and having coal tar deposit thereon; and, the recovered amount of sensible heat and condensation heat of the crude coke-oven gas 2 and the substances contained therein.

EXAMPLE FOR COMPARISON

For comparison purposes, as in Example 1, a blended raw material coal fine having the properties as shown in Table 2 was prepared from the kinds of coal at the blending ratios as shown in Table 1. Then, in accordance with the conventional dried coal charging method described above, the blended raw material coal fine thus prepared was dried through heat exchange with a combustion exhaust gas of a clean coke-oven gas. In Example for Comparison, therefore, sensible heat and condensation heat of the crude coke-oven gas and the substances contained therein were not recovered nor utilized, and no coal tar was caused to deposit onto the particle surfaces of the blended raw material coal fine thus dried.

Table 3 shows, for Example for Comparison, the water content, the temperature and the charging bulk density of the blended raw material coal fine before and after said drying treatment; and, the yield rate and the strength of coke produced from the blended raw material coal fine subjected to said drying treatment.

TABLE 1

| Kind of coal | Blending ratio (%) |
|---|---|
| Itmann Coal | 5 |
| Coal Cliff Coal | 10 |
| South Bulli Coal | 10 |
| Balmer Coal | 15 |
| Black Water Coal | 10 |
| Moura Coal | 30 |

TABLE 1-continued

| Kind of coal | Blending ratio (%) |
|---|---|
| Daiyon Coal | 17 |
| Oil Coke | 3 |

TABLE 2

| | |
|---|---|
| Ash | 9.8% |
| Volatile matters | 28.2% |
| Inert component | 28.6% |
| Mean maximum reflectance | 1.14% |
| Maximum fluidity | 21 ddpm |

TABLE 3

| | | | | Example 1 | Example 2 | Example 3 | Example 4 | Example for Comparison |
|---|---|---|---|---|---|---|---|---|
| Blended raw material coal fine for charging into coking ovens | Before drying and prehating treatment | Water content | (wt. %) | 7.4 | 7.2 | 8.0 | 8.0 | 8.0 |
| | | Temperature | (°C.) | 29 | 20 | 25 | 25 | 25 |
| | | Charging bulk density | ($t/m^3$) | 0.723 | 0.725 | 0.718 | 0.715 | 0.720 |
| | After drying and preheating treatment | Water content | (wt. %) | 4.5 | 2.0 | 0 | 0 | 4.5 |
| | | Amount of coal tar deposit | (wt. %) | 0.8 | 1.3 | 2.2 | 2.5 | 0 |
| | | Temperature | (°C.) | 47 | 64 | 124 | 200 | 45 |
| | | Charging bulk density | ($t/m^3$) | 0.745 | 0.748 | 0.823 | 0.814 | 0.743 |
| | Consumption | | ($Nm^3$/t-Coal) | 119 | 167 | 248 | 300 | — |
| Crude coke-oven gas | Coal tar content | | ($kg/Nm^3$) | 0.19 | 0.18 | 0.17 | 0.17 | — |
| | Temperature | | (°C.) | 800 | 800 | 800 | 800 | — |
| Recycle clean coke-oven gas | Consumption | | ($Nm^3$/t-Coal) | 204 | 136 | 49 | — | — |
| | Temperature | | (°C.) | 25 | 25 | 25 | — | — |
| Mixed coke-oven gas (or crude coke-oven gas) introduced into the drying and preheating chamber | Consumption | | ($Nm^3$/t-Coal) | 323 | 303 | 297 | 300 | — |
| | Temperature on the entry side of the drying and preheating chamber | | (°C.) | 380 | 500 | 700 | 800 | — |
| | Temperature on the exit side of the drying and preheating chamber | | (°C.) | 200 | 200 | 200 | 200 | — |
| Manufactured coke | Yield | | (kg/t-Coal) | 734 | 737 | 741 | 743 | 730 |
| | Strength | | ($DI_{15}^{30}$) | 90.9 | 92.2 | 93.8 | 94.0 | 90.3 |
| Amount of recovered heat of crude coke-oven gas (Kcal/t-coal) | | | | $27 \times 10^3$ | $45 \times 10^3$ | $77 \times 10^3$ | $97 \times 10^3$ | 0 |

As shown in Table 3, in Examples 1 to 4, a viscous coal tar in an amount of from 0.8 to 2.5 wt.% was caused to deposit onto the particle surfaces of the blended raw material coal fine to be charged into coking ovens of the coke oven battery, and prevented occurrence of coal dust troubles as in the conventional dried coal charging or preheated coal charging method. Also in Examples 1 to 4, under the effect of the drying and preheating of the blended raw material coal fine and the effect of the coal tar deposit on the particle surfaces thereof, the manufactured coke showed such excellent values as a yield rate of from 734 to 743 kg per ton of coal charge and a strength of from 90.9 to 94.0 $DI_{15}^{30}$. In Examples 1 to 4, furthermore, sensible heat and condensation heat of the crude coke-oven gas and the substances contained therein were recovered and utilized to such a large extent as from $27 \times 10^3$ to $97 \times 10^3$ Kcal per ton of coal charge.

In Example for Comparison, on the contrary, sensible heat and condensation heat of the crude coke-oven gas and the substances contained therein were not utilized at all, but transferred to a large quantity of cooling water and were wasted with no utilization. It was furthermore necessary to consume a large quantity of clean coke-oven gas for drying the blended raw material coal fine. In addition, in Example for Comparison, because coal tar did not deposit onto the particle surfaces of the blended raw material coal fine, not only there was a serious splashing of coal dust, but also the manufactured coke showed a yield rate of 730 kg per ton of coal charge and a strength of 90.3 $DI_{15}^{30}$, both lower than those in Examples 1 to 4.

According to the method of the present invention, described above in detail, the following industrially useful effects are provided:

(1) It is possible not only to solve coal dust troubles inevitably occurring in the conventional dried or preheated coal charging method, but also to apply the dried coal charging method or the preheated coal charging method with the use of only the advantages of these methods.

(2) It is possible not only to effectively recover and utilize sensible heat and condensation heat of crude coke-oven gas and substances contained therein which have conventionally been wasted with no utilization, but also to avoid consuming clean coke-oven gas for drying and preheating blended raw material coal fine as is necessary in the conventional dried or preheated coal charging method.

(3) Coke yield rate per ton of coal charge is improved since the coal tar deposit on the particle surfaces of blended raw material coal fine is converted into coke through carbonization in coking ovens of the coke oven battery.

(4) The coal tar deposit on the particle surfaces of blended raw material coal fine, serving as a bonding agent, improves strength of manufactured coke.

What is claimed is:

1. A method for recovering and utilizing heat of a coke-oven gas, which comprises the steps of:

introducing at least a part of a high-temperature coke-oven gas generated from a coke oven battery and containing vaporized coal tar, vaporized low boiling point substances and dust into a drying and preheating chamber, while supplying a blended raw material coal fine to be charged into coking ovens of said coke-oven battery into said drying and preheating chamber;

drying and preheating said coal fine through heat exchange with said coke-oven gas in said drying and preheating chamber, while causing most of the vaporized coal tar contained in said coke-oven gas to condense and deposit onto the particle surfaces of said coal fine, thereby recovering and utilizing sensible heat and condensation heat of said coke-oven gas and substances contained therein; and, charging said coal fine, dried and preheated in said drying and preheating chamber and onto the particle surfaces of which coal tar has deposited, into coking ovens of said coke oven battery.

2. The method as claimed in claim 1, which comprises:

fluidizing said coal fine, dried and preheated in said drying and preheating chamber and onto the particle surfaces of which coal tar has deposited, in said drying and preheating chamber, by means of said coke-oven gas introduced into said drying and preheating chamber, and causing said coal fine to continuously overflow from said drying and preheating chamber, thereby collecting by separation said coal fine from said coke-oven gas.

3. The method as claimed in claim 1 or 2, which comprises:

adding to and mixing with said coke-oven gas which is introduced into said drying and preheating chamber, clean coke-oven gas.

* * * * *

UNITED STATES PATENT AND TRADEMARK OFFICE

CERTIFICATE OF CORRECTION

PATENT NO. : 4,270,980

DATED : June 2, 1981

INVENTOR(S) : Teruo Shimotsuma et al.

It is certified that error appears in the above—identified patent and that said Letters Patent is hereby corrected as shown below:

The title page should be deleted to appear as per attached title page.

Figures 1 and 2 of the drawings should be deleted to appear as per attached figures 1 and 2.

United States Patent [19]

Shimotsuma et al.

[11] 4,270,980

[45] Jun. 2, 1981

[54] METHOD FOR RECOVERING AND UTILIZING HEAT OF COKE-OVEN GAS

[75] Inventors: Teruo Shimotsuma; Kazuo Kunioka; Hiroaki Nishio, all of Yokohama; Yasuo Okuyama, Kawasaki, all of Japan

[73] Assignee: Nippon Kokan Kabushiki Kaisha, Tokyo, Japan

[21] Appl. No.: 35,457

[22] Filed: May 3, 1979

[30] Foreign Application Priority Data

May 26, 1978 [JP] Japan ..... 53-62183

[51] Int. Cl.[3] ..... C10B 49/02; C10B 51/00; C10B 55/02; C10B 57/10

[52] U.S. Cl. ..... 201/28; 48/210; 201/23; 201/29; 201/36; 201/41; 201/45

[58] Field of Search ..... 201/23, 24, 28, 29, 201/31, 36, 41, 43, 45; 48/210

[56] References Cited

U.S. PATENT DOCUMENTS

| | | | |
|---|---|---|---|
| 3,432,398 | 3/1969 | Schmidt | 201/38 |
| 3,454,383 | 7/1969 | Pirsh et al. | 201/31 X |
| 3,867,110 | 2/1975 | Schora et al. | 201/31 X |
| 4,104,128 | 8/1978 | Faber et al. | 201/28 X |

FOREIGN PATENT DOCUMENTS

| | | | |
|---|---|---|---|
| 2103026 | 8/1971 | Fed. Rep. of Germany | 201/31 |

*Primary Examiner*—Joseph Scovronek

*Attorney, Agent, or Firm*—Frishauf, Holtz, Goodman & Woodward

[57] ABSTRACT

A method for recovering and utilizing heat of coke-oven gas, which comprises: through heat exchange with a high-temperature coke-oven gas generated from a coke oven battery and containing vaporized coal tar, vaporized low boiling point substances and dust, drying and preheating a blended raw material coal fine to be charged into coking ovens of said coke oven battery, and, on the other hand, causing most of said coal tar contained in said coke-oven gas to condense and deposit onto the particle surfaces of said coal fine during the process of said heat exchange, thereby recovering and utilizing sensible heat and condensation heat of said coke-oven gas and substances contained therein, and at the same time, eliminating most of the contained coal tar from said coke-oven gas.

3 Claims, 2 Drawing Figures

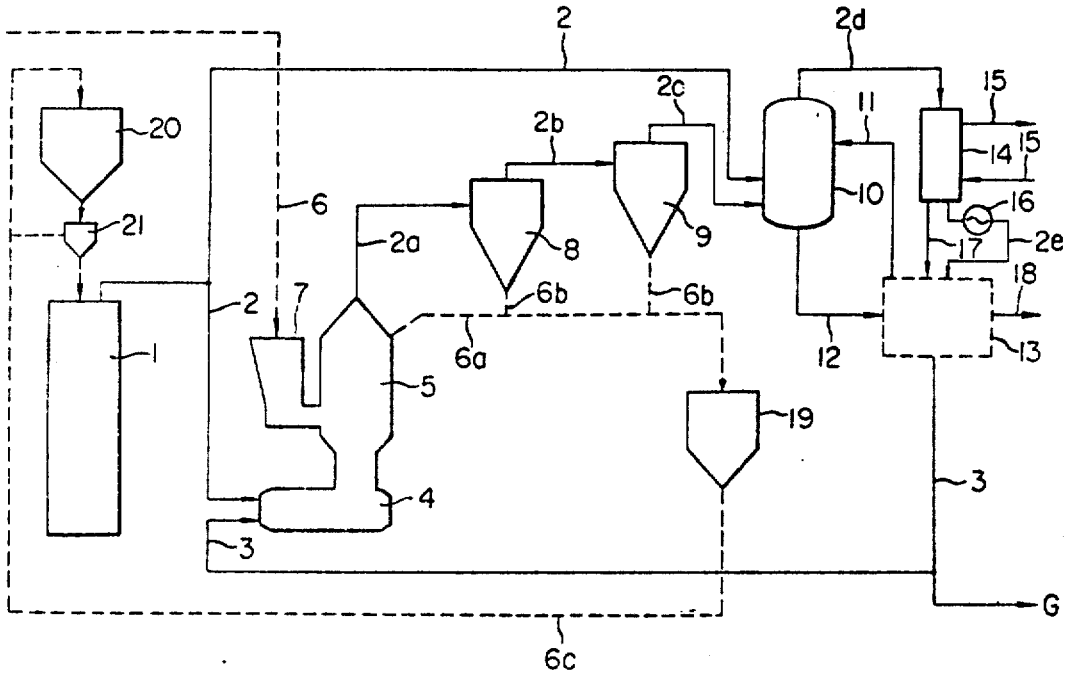

UNITED STATES PATENT AND TRADEMARK OFFICE

CERTIFICATE OF CORRECTION

PATENT NO. : 4,270,980

DATED : June 2, 1981

INVENTOR(S) : Teruo Shimotsuma et al.

It is certified that error appears in the above—identified patent and that said Letters Patent is hereby corrected as shown below:

FIG. 1

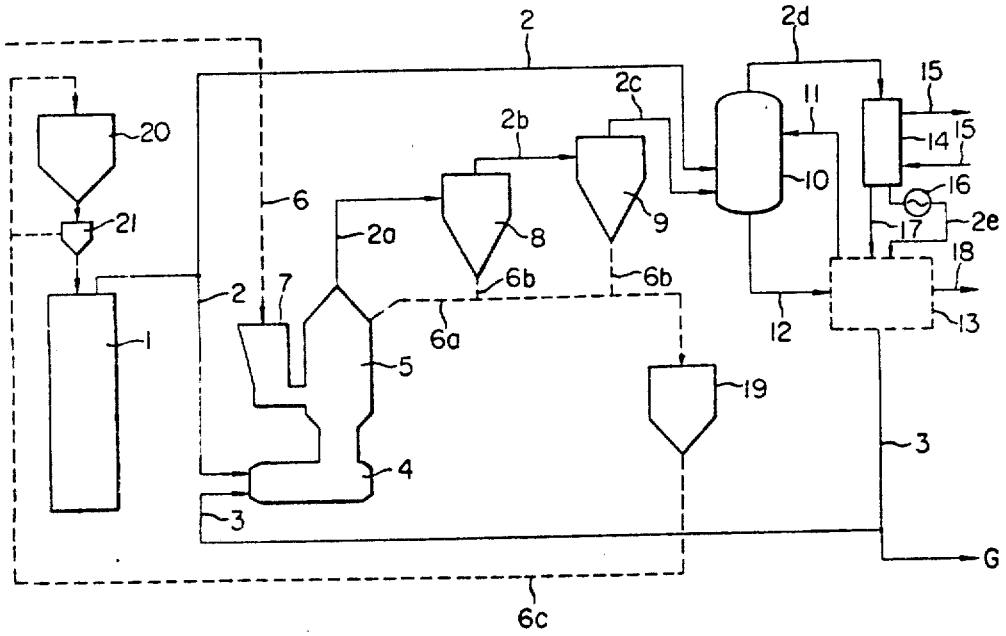

UNITED STATES PATENT AND TRADEMARK OFFICE

CERTIFICATE OF CORRECTION

PATENT NO. : 4,270,980 Page 4 of 4

DATED : June 2, 1981

INVENTOR(S) : Teruo Shimotsuma et al.

It is certified that error appears in the above—identified patent and that said Letters Patent is hereby corrected as shown below:

FIG. 2

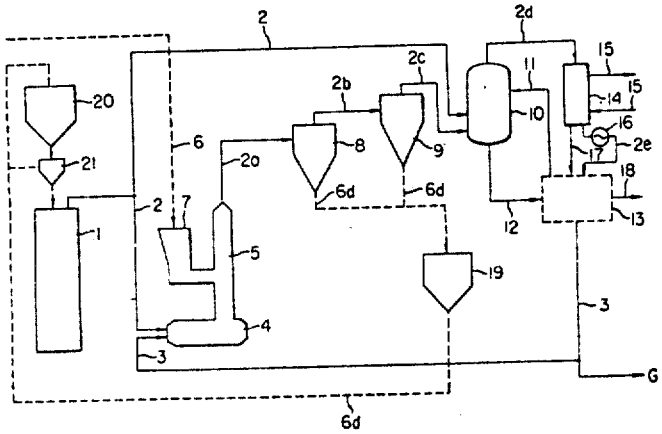

Signed and Sealed this

Thirteenth Day of July 1982

[SEAL]

Attest:

GERALD J. MOSSINGHOFF

Attesting Officer

Commissioner of Patents and Trademarks